US010030893B2

(12) United States Patent
Hofbauer

(10) Patent No.: US 10,030,893 B2
(45) Date of Patent: Jul. 24, 2018

(54) FOUR-PROCESS CYCLE FOR A VUILLEUMIER HEAT PUMP

(71) Applicant: ThermoLift, Inc., Stony Brook, NY (US)

(72) Inventor: Peter Hofbauer, West Bloomfield, MI (US)

(73) Assignee: ThermoLift, Inc., Stony Brook, NY (US)

( * ) Notice: Subject to any disclaimer, the term of this patent is extended or adjusted under 35 U.S.C. 154(b) by 157 days.

(21) Appl. No.: 15/037,493

(22) PCT Filed: Nov. 18, 2014

(86) PCT No.: PCT/US2014/066098
§ 371 (c)(1),
(2) Date: May 18, 2016

(87) PCT Pub. No.: WO2015/077214
PCT Pub. Date: May 28, 2015

(65) Prior Publication Data

US 2016/0298878 A1 Oct. 13, 2016

Related U.S. Application Data

(60) Provisional application No. 61/907,268, filed on Nov. 21, 2013.

(51) Int. Cl.

| | |
|---|---|
| ***F25B 9/00*** | (2006.01) |
| ***F25B 9/14*** | (2006.01) |
| ***F25B 30/00*** | (2006.01) |
| ***F02G 1/043*** | (2006.01) |

(52) U.S. Cl.
CPC ..... *F25B 9/14* (2013.01); *F02G 1/0435* (2013.01); *F25B 30/00* (2013.01); *F02G 2243/02* (2013.01); *F02G 2280/10* (2013.01)

(58) Field of Classification Search
CPC ..... F02G 2243/02; F02G 2280/10; F02G 1/0435; F25B 30/00; F25B 9/14; F17C 2205/0323
See application file for complete search history.

(56) References Cited

U.S. PATENT DOCUMENTS 3,423,948 A * 1/1969 Cowans ..... F02G 1/0445 62/6
4,801,308 A 1/1989 Keefer
4,969,333 A * 11/1990 Osawa ..... F02G 1/0445 60/524

(Continued)

FOREIGN PATENT DOCUMENTS

WO 2013155258 A1 10/2013

*Primary Examiner* — Len Tran
*Assistant Examiner* — Ana Vazquez
(74) *Attorney, Agent, or Firm* — Diana D. Brehob

(57) ABSTRACT

A four-process cycle is disclosed for a Vuilleumier heat pump that has mechatronically-controlled displacers. Vuilleumier heat pumps that use a crank to drive the displacers have been previously developed. However, mechatronic controls provides a greater degree of freedom to control the displacers. The four-process cycle provides a higher coefficient of performance than prior cycles in the crank-driven Vuilleumier heat pump and those previously disclosed for a mechatronically-driven Vuilleumier heat pump.

11 Claims, 5 Drawing Sheets

(56) References Cited

U.S. PATENT DOCUMENTS

| | | | | |
|---|---|---|---|---|
| 5,301,506 | A | 4/1994 | Pettingill | |
| 5,483,802 | A | 1/1996 | Kawajiri | |
| 5,615,556 | A * | 4/1997 | Honda | F02G 1/0445 60/520 |

* cited by examiner

FOUR-PROCESS CYCLE FOR A VUILLEUMIER HEAT PUMP

FIELD OF INVENTION

The present disclosure relates to cycles in heat pumps, particularly Vuilleumier heat pumps.

BACKGROUND

The displacers in most prior art Vuilleumier heat pumps are driven by a crank, such as shown in U.S. Pat. No. 1,275,507. A schematic of such a heat pump with crank driven displacers is shown in FIG. 1. In the '507 patent, the displacers have a phase difference of 90 degrees as shown in FIG. 2. A mechatronically-driven Vuilleumier heat pump, which is commonly assigned to the assignee of the present disclosure, has been disclosed in WO 2013/155258. In such a heat pump, the displacers are independently actuated allowing one displacer to remain stationary while the other displacer moves, which provides many additional degrees of freedom in controlling displacer motion. In the WO 2013/155258 A1 publication, a three-process cycle is also disclosed. A cycle that provides a high coefficient of performance is desired.

SUMMARY

A four-process cycle is disclosed that demonstrates a higher coefficient of performance than the previously disclosed three-process cycle based on modeling results.

A method to operate a heat pump is disclosed. The heat pump has a hot displacer adapted to reciprocate within a hot cylinder and a cold displacer adapted to reciprocate within a cold cylinder. The hot displacer has a remote position and a central position and the cold displacer has a central position and a remote position. The method includes: actuating the hot displacer to move from its central position to its remote position, actuating the cold displacer to move from its central position to its remote position, actuating the hot displacer to move from its remote position to its central position, and actuating the cold displacer to move from its remote position to its central position wherein the actuations occur in the given order.

At some operating conditions, the cold displacer remains stationary for at least a portion of the time during which the hot displacer moves between its central and remote positions and the hot displacer remains stationary for at least a portion of the time during which the cold displacer moves between it remote and central positions.

The actuating the hot displacer to move from its central position to its remote position comprises process one. The actuating the cold displacer to move from its central position to its remote position comprises process two. The actuating the hot displacer to move from its remote position to its central position comprises process three. The actuating the cold displacer to move from its remote position to its central position comprises process four. A cycle is made up of process one followed by process two followed by process three followed by process four.

The method may further include: commanding both displacers to remain stationary for a first predetermined time between process one and process two, commanding both displacers to remain stationary for a second predetermined time between process two and process three, commanding both displacers to remain stationary for a third predetermined time between process three and process four, and commanding both displacers to remain stationary for a fourth predetermined time between process four and process one.

A hot chamber is defined within the hot displacer cylinder with volume within the hot chamber related to the position of the hot displacer within the hot displacer cylinder. A cold chamber is defined within the cold displacer cylinder with volume within the cold chamber related to the position of the cold displacer within the cold displacer cylinder. When the hot displacer is in its remote position, the volume in the hot chamber is less than when the hot displacer is in its central position. When the cold displacer is in its remote position, the volume in the cold chamber is less than when the cold displacer is in its central position.

A heat pump is disclosed that has a hot displacer disposed in a hot displacer cylinder, a cold displacer disposed in a cold displacer cylinder, a hot displacer actuator which when actuated causes the hot displacer to reciprocate between remote and central positions within the hot displacer cylinder, a cold displacer actuator which when actuated causes the cold displacer to reciprocate between remote and central positions within the cold displacer cylinder, and an electronic control unit (ECU) coupled to the hot displacer actuator and the cold displacer actuator. The ECU commands the hot displacer and cold displacer to move through a series of arrangements: a first arrangement in which the hot displacer is at its central position within the hot displacer cylinder and the cold displacer is proximate its central position with the cold displacer cylinder, a second arrangement in which the hot displacer is at its remote position within the hot displacer cylinder and the cold displacer is proximate its central position with the cold displacer cylinder, a third arrangement in which the hot displacer within the hot displacer cylinder is at its remote position and the cold displacer is proximate its remote position within the cold displacer cylinder, and a fourth arrangement in which the hot displacer is at its central position within the hot displacer cylinder and the cold displacer is proximate its remote position within the cold displacer cylinder.

A cycle comprises moving from the first arrangement to the second arrangement to the third arrangement to the fourth arrangement to the first arrangement.

The cold displacer remains stationary in its central position for at least a portion of the time that it takes for the hot displacer to move from its central position to its remote position. The hot displacer remains stationary in its remote position for at least a portion of the time that it takes the cold displacer to move from its central position to its remote position. The cold displacer remains stationary in its remote position for at least a portion of the time that it takes the hot displacer to move from its remote position to its central position. The hot displacer remains stationary in its central position for at least a portion of the time that it takes the cold displacer to move from its remote position to its central position.

In some embodiments, the central axis of the cold displacer cylinder is collinear with a central axis of the hot displacer cylinder. In some embodiments, a diameter of the cold displacer cylinder is greater than a diameter of the hot displacer cylinder. In another embodiment, the diameter of the hot displacer cylinder is greater than a diameter of the cold displacer cylinder. In yet other embodiments, a diameter of the hot displacer cylinder is equal to a diameter of the cold displacer cylinder. In some embodiments, a distance that the hot displacer moves from its remote position to its central position is greater than a distance that the cold displacer moves from its remote position to its central position. In another embodiment, a distance that the hot displacer moves from its remote position to its central position is less than a distance that the cold displacer moves from it remote position to its central position. In some embodiments, a time that it takes for the hot displacer to move between its central and remote positions is different than a time that it takes for the cold displacer to move between its central and remote positions. In a heat pump in which the actuator includes springs, the springs acting on the displacers can be selected such that times for the displacers to move between their respective central and remote positions are unequal.

A heat pump is disclosed in which a hot displacer disposed in a hot displacer cylinder is adapted to reciprocate within the hot displacer cylinder and a cold displacer is disposed in a cold displacer cylinder and adapted to reciprocate within the cold displacer cylinder. The heat pump has a hot displacer actuator coupled to the hot displacer, the hot displacer actuator is adapted to cause the hot displacer to move between a central position and a remote position within the hot displacer cylinder, a cold displacer actuator coupled to the cold displacer, the cold displacer actuator is adapted to cause the cold displacer to move between a central position and a remote position within the cold displacer cylinder, and an electronic control unit (ECU) coupled to the hot displacer actuator and the cold displacer actuator. A cycle includes the following processes in the following order: the hot displacer actuator commands the hot displacer to move from the central position to the remote position within the hot displacer cylinder, the cold displacer actuator commands the cold displacer to move from central position to the remote position within the cold displacer cylinder, the hot displacer actuator commands the hot displacer to move from the remote position to the central position within the hot displacer cylinder, and the cold displacer actuator commands the cold displacer to move from remote position to the central position within the cold displacer cylinder.

The heat pump has a hot chamber at one end of the hot displacer cylinder, and a cold chamber at one end of the cold displacer cylinder. Volume in the hot chamber is greater when the hot displacer is in the central position than when the displacer is in the remote position. Volume in the cold chamber is greater when the cold displacer is in the central position than when the cold displacer is in the remote position. The heat pump includes a warm chamber which is a volume within the hot cylinder at the opposite end of the hot displacer from the hot chamber added to a volume within the cold cylinder at the opposite end of the cold displacer from the cold chamber.

In some embodiments, a central axis of the hot displacer cylinder is collinear with a central axis of the cold displacer. In other embodiments, a central axis of the hot displacer cylinder is substantially parallel to and offset from a central axis of the cold displacer. In some embodiments, the diameter of the hot displacer cylinder is greater than the diameter of the cold displacer cylinder.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
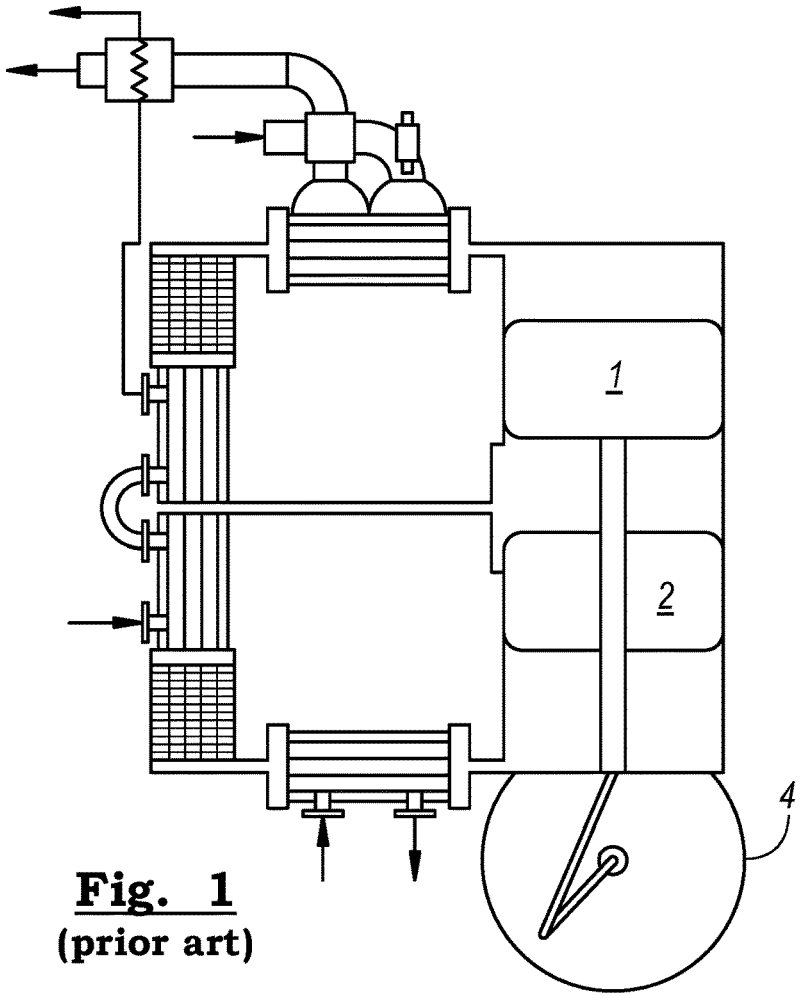
Fig. 1 (prior art)
FIG. 1 is a schematic of a prior art Vuilleumier heat pump.
Figure 2:
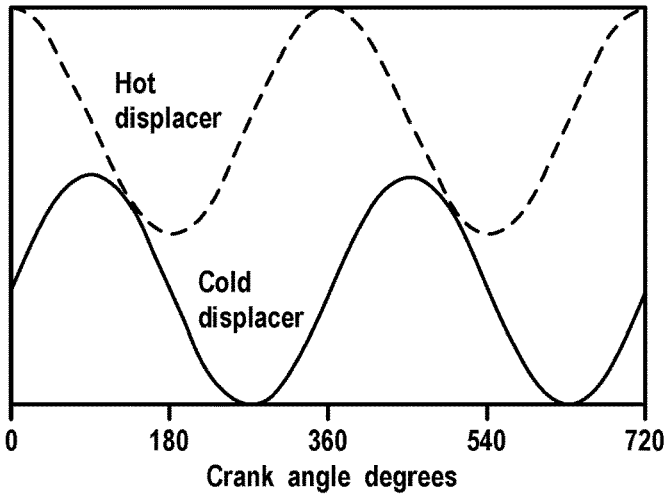
Fig. 2 (prior art)
FIG. 2 is a graph of displacer movement in the Vuilleumier heat pump with crank-driven displacers.
Figure 3:
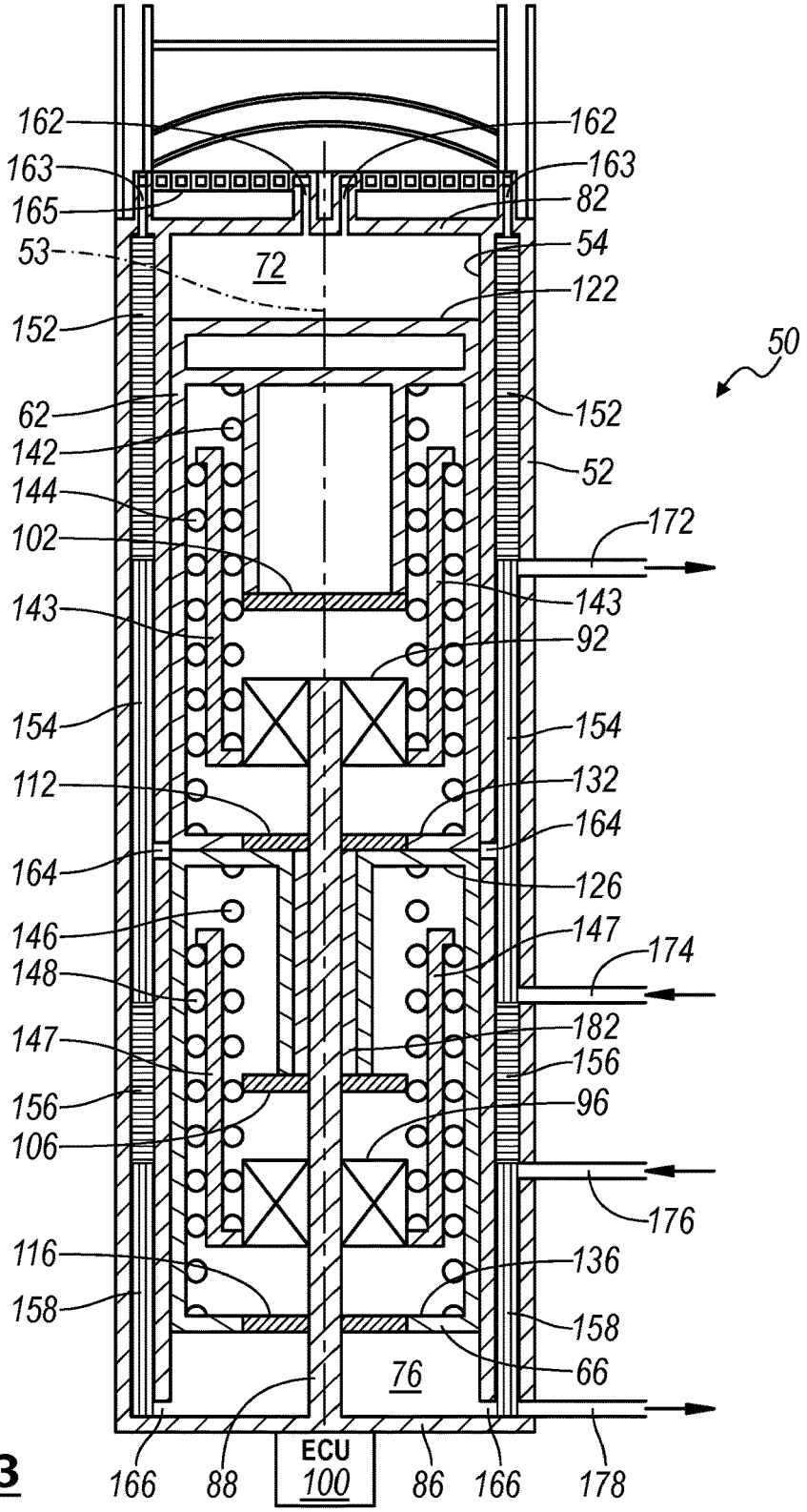
FIG. 3 is a schematic representation of a Vuilleumier heat pump with mechatronically-controlled displacers.
Figure 6:
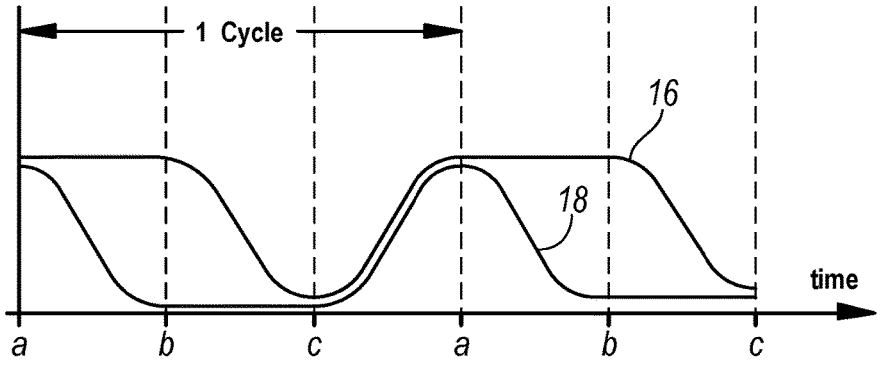
FIG. 6 is a chart showing movement of the hot and cold displacers as a function of time for a three-process cycle.

Before describing cycles that are facilitated by a mechatronically-actuated Vuilleumier heat pump, a non-limiting example of such a heat pump 50 is shown in FIG. 3. Heat pump 50 has a housing 52 and a cylinder 54 into which hot displacer 62 and cold displacer 66 are disposed. Displacers 62 and 66 reciprocate within cylinder liner 54 moving along central axis 53. An actuator for hot displacer 62 includes: ferromagnetic elements 102 and 112, electromagnet 92, springs 142 and 144, and a support structure 143. Support structure 143, as shown in FIG. 6 is attached to the electromagnet 92, which is coupled to a central post 88 that is coupled to a cold end 86 of housing 52. Post 88, electromagnet 92, and support structure 143 are stationary. When hot displacer 62 reciprocates upward from the position shown in FIG. 6, spring 142 is compressed to a greater degree than its equilibrium preload and 144 is under a lower compression. Electromagnet 92 is energized to pull ferromagnetic elements 102 or 112 toward it, against the spring forces of springs 142 and 144. Analogously, cold displacer 66 has a cold actuator that includes: an electromagnet 96 coupled to post 88, a support structure 147 coupled to electromagnet 96, and springs 146 and 148. Spring 146 is coupled between support structure 147 and a first cap 126 of cold displacer 66. Spring 148 is coupled between support structure 147 and a second cap 136 of cold displacer 66. Electromagnet 92 and 96 are controlled via an electronic control unit (ECU) 100.

Ferromagnetic blocks 102, 112, 106, and 116 are coupled to: a standoff associated with a first cap 122 of hot displacer 62, a second cap 132 of hot displacer 62, a standoff associated with first cap 126 of cold displacer 66, and second cap 136 of cold displacer 66, respectively. Openings are provided in second cap 132 of hot displacer 62, and first and second caps 126 and 136 of cold displacer 66 to accommodate post 88 extending upwardly through cold displacer 66 and into hot displacer 62.

An annular chamber is formed between a portion of the inner surface of housing 52 and the outer surface of cylinder 54. A hot recuperator 152, a warm heat exchanger 154, a cold recuperator 156, and a cold heat exchanger 158 are disposed within the annular chamber. Openings through cylinder 54 allow fluid to pass between the interior of cylinder 54 to the annular chamber. Openings 166 allow for flow between a cold chamber 76 and cold heat exchanger 158 in the annular chamber. Openings 164 allow flow between a warm chamber and the annular chamber. Heat pump 50 also has a hot heat exchanger 165 that is provided near a hot end of housing 52. Openings 162 through cap 82 lead to heat exchanger 165 which has passages 163 which lead to the annular chamber. Hot heat exchanger 165 may be associated with a burner arrangement or other energy source. A fluid that is to be heated flows to warm heat exchanger 154 into opening 174 and out opening 172, cross flow. Fluid that is to be cooled flows to cold heat exchanger 158 in at opening 176 and exits at opening 178. The flow through the heat exchangers may be reversed, parallel flow.

Figure 4:
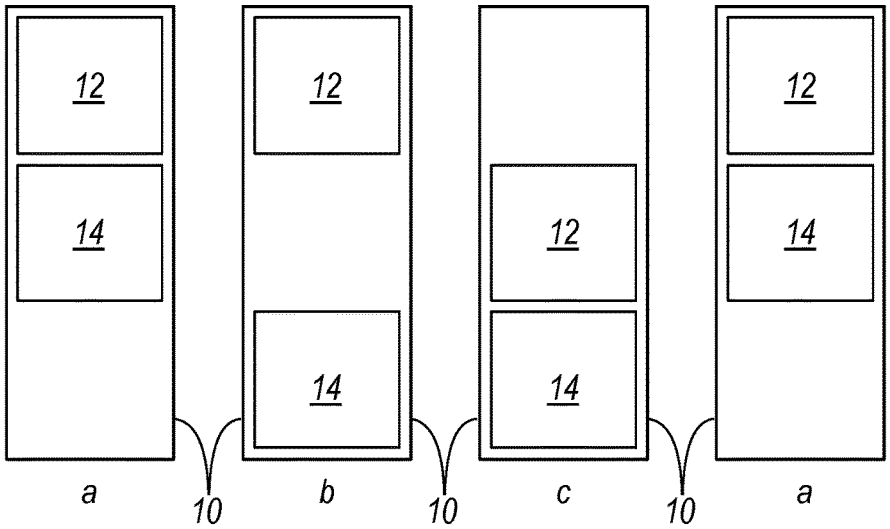
FIG. 4 is a representation of a three-process cycle in the Vuilleumier heat pump.

The end positions of the displacers in a three-process cycle in the Vuilleumier heat pump are illustrated in FIG. 4. At state 'a', both a hot displacer 12 and a cold displacer 14 are at their upper positions within a cylinder 10. In state 'b' in FIG. 3, cold displacer 14 moves to its lower position. A change from state 'a' to state 'b' is a first process. From state 'b' to state 'c', hot displacer 12 moves from its upper to its lower position, i.e., a second process. In moving from state 'c' back to state 'a', both hot displacer 12 and cold displacer 14 move upwards, which is a third process.

In the cycle illustrated in FIG. 4, hot displacer 12 and cold displacer 14 are in a central space within cylinder 10 at different points in the cycle. That is, at state 'a', cold displacer 14 is in the central space in cylinder 10 and at state 'c', hot displacer 12 is in the central space in cylinder 10. The heat pump in FIG. 3 is suitable for a three-process cycle. A heat pump that would allow a four-process cycle is similar to that in FIG. 3, except that the cylinder is elongated, the reason for which will become clear from the discussion below.

Figure 5:
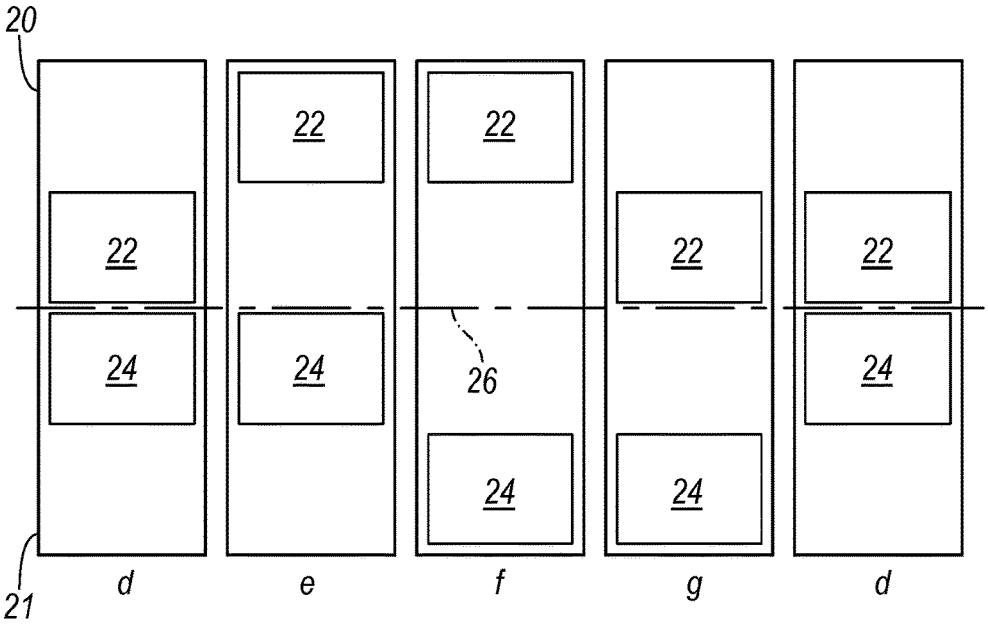
FIG. 5 is a representation of a four-process cycle in the Vuilleumier heat pump.

A four-process cycle for use in a Vuilleumier heat pump is shown in FIG. 5 in which a hot displacer 22 reciprocates within a hot displacer cylinder 20 and a cold displacer 24 reciprocates with a cold displacer cylinder 21. At state 'd', a hot displacer 22 is at its central position within cylinder 20 and a cold displacer 24 is at its central position within cylinder 21. In going from state 'd' to state 'e', hot displacer 22 moves to its remote position within cylinder 20. This is a first process or process one. In going from state 'e' to 'f', cold displacer 24 moves to its remote position within cylinder 21. This is a second process or process two. From state T to 'g', hot displacer 22 moves to its central position within cylinder 20; a third process or process three. In moving from state 'g' to back to state 'd', cold displacer 24 moves to its central position within cylinder 21, undergoing a fourth process or process four.

As discussed above, in the three-process cycle in FIG. 4, hot displacer 12 and cold displacer 14 occupy the same space but, of course, at different times during the cycle. In the four-process cycle of FIG. 5, hot displacer 22 and cold displacer 24 do not cross a center line 26. Cylinders 20 and 21 are collinear and of the same diameter and are denoted by cylinder 20 being above center line 26 and cylinder 21 being below center line 26.

The displacer movement end positions illustrated in FIG. 4 are shown as a function of time in FIG. 6. The movement of the lower edge of the hot displacer is shown as curve 16. The movement of the upper edge of the cold displacer is shown as curve 18. The cold displacer moves downward in going from state 'a' to state 'b' while the hot displacer is stationary. From 'b' to 'c', the hot displacer moves downward while the cold displacer is stationary. And from 'c' to 'a', which completes the cycle, both displacers move upward.

Figure 7:
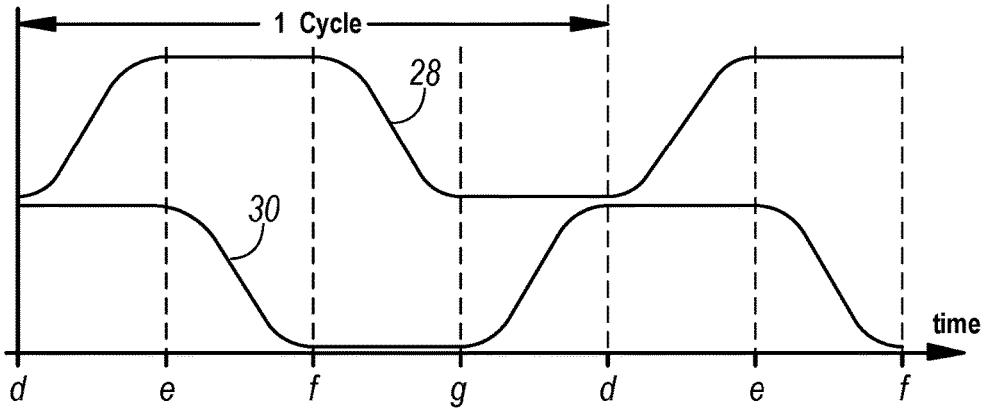
FIG. 7 is a chart showing movement of the hot and cold displacers as a function of time for a four-process cycle.

The displacer movement end positions illustrated in FIG. 5 are shown as a function of time in FIG. 7. The lower edge of the hot displacer is plotted as curve 28 and the upper edge of the cold displacer is plotted as curve 30. At state 'd', the displacers are both in their central positions and proximate each other. From state 'd' to state 'e', the cold displacer remains stationary and the hot displacer moves upward. From 'e' to T, the hot displacer remains stationary and the cold displacer moves downward. From T to 'g', the hot displacer moves downward and the cold displacer remains stationary. From 'g' to return to the starting position 'd', the hot displacer remains stationary and the cold displacer moves upward. The cycle in FIG. 6 is completed in three processes and the cycle in FIG. 7 is completed in four processes. Thus, if the displacers move at the same speed in the cycle in FIG. 6 as in FIG. 7, the cycle in FIG. 7 takes longer, about 1⅓ times longer to complete than the cycle in FIG. 6 when the displacers have the same dynamics.

Figure 8:
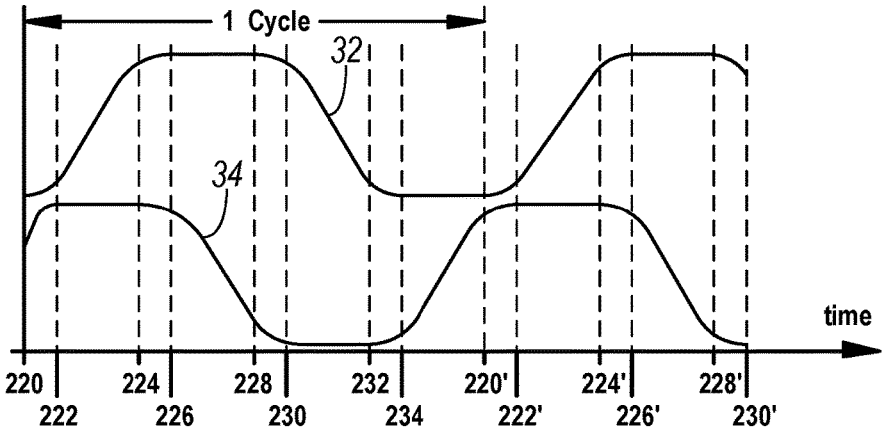
FIG. 8 is a chart showing movement of the hot and cold displacers as a function of time for a four-process cycle in which movement of the displacers overlap.

An alternative to the cycle in FIG. 7 is a cycle shown in FIG. 8 in which the movements of the displacers overlap slightly. The upper edge of the hot displacer movement is illustrated by curve 32; the lower edge of the cold displacer is illustrated by curve 34. At time 220 in FIG. 8, the cold displacer is finishing its upward movement and the hot displacer is starting its upward movement. At time 222, the cold displacer has attained its upper position (its remote position) and remains there until time 224. At time 224, the hot displacer has not yet arrived at the upper position (its remote position), which happens at time 226. Meanwhile, the cold displacer finishes the upward travel during time 224 to 226. The hot displacer is stationary at its upper position from 226 to 228. The cold displacer completes the downward travel at time 230 and then stays at the lower position until time 232. Meanwhile, the hot displacer moves downwardly from time 228 through time 234. At time 232, the cold displacer moves upwardly through time 234, time 220', and time 222'. The hot displacer remains stationary from time 234 through time 220'. At time 220', a complete cycle has been completed; the positions of the displacers are the same at time 220 as at time 220'.

The rate at the displacers move is determined by the spring constants and other properties of the system. As the illustrations in FIGS. 7 and 8 refer to the same configuration, the displacers move at the same rate in FIGS. 7 and 8. However, because movement in the hot displacer is initiated before the cold displacer attains its extreme position and vice versa in the cycle shown in FIG. 8, the FIG. 8 cycle occurs in less time than that in FIG. 7. Such a cycle provides a higher output.

Figure 9:
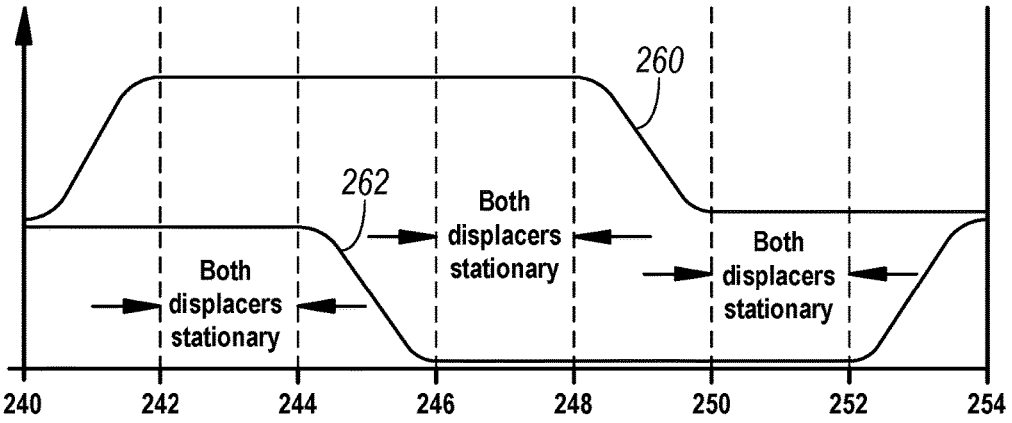
FIG. 9 is a chart showing movement of the hot and cold displacers in which there are periods in which both displacers remain stationary.

The discussion of cycles in regards to FIGS. 6-8 describe the highest output cycles that are possible. To obtain a downturn in output, both displacers remain stationary for a period between portions of the cycle. An example of such displacer movement is shown in FIG. 9. The hot displacer movement is shown as curve 260 and the cold displacer movement is shown as curve 262. At time 240, both displacers are in their central positions within their cylinders.

The hot displacer moves upward between time 240 and time 242. Both displacers are stationary between time 242 and time 244. The duration can be shorter or longer than that shown in FIG. 9. Other intervals during which both displacers are stationary are between time 246 and time 248 and between time 250 and time 252. Again, these can be shorter or longer to meet demanded output. Furthermore, the interval during which the displacers may be different in different parts of the cycle. E.g., the interval between time 242 and time 244 when the hot displacer is at its remote position and the cold displacer is at its central position can be of a different length than either of the other intervals: time 246 to time 248 or time 250 to time 252.

Figure 10:
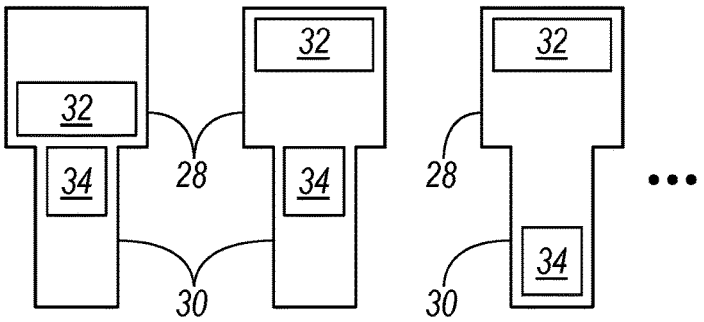
FIG. 10 is a representation of a Vuilleumier heat pump in which the diameter of the hot displacer cylinder is greater than the diameter of the cold displacer cylinder.
Figure 11:
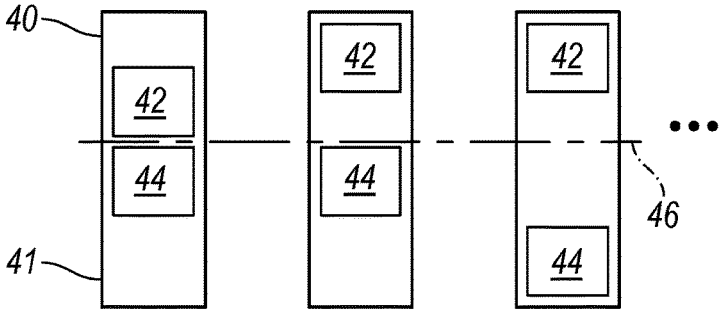
FIG. 11 is a representation of a Vuilleumier heat pump in which the stroke of the hot displacer is less than the stroke of the cold displacer.

A Vuilleumier heat pump in which the diameters of the cylinders are different is shown in FIG. 10. A hot displacer cylinder 28 has a greater diameter than cold displacer cylinder 30. A hot displacer 32 that reciprocates within hot displacer cylinder 28 is also greater than cold displacer 34 that reciprocates within cold displacer cylinder 32. A heat pump in which the strokes are different is shown in FIG. 11. A hot displacer cylinder 40 has a hot displacer 42; and a cold displacer cylinder 41 has a cold displacer 44. The stroke of hot displacer 42 is less than the stroke of cold displacer 44.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. A method to operate a heat pump, the heat pump having a hot displacer adapted to reciprocate within a hot cylinder and a cold displacer adapted to reciprocate within a cold cylinder wherein the hot displacer has a remote position and a central position within the hot cylinder and the cold displacer has a central position and a remote position within the cold cylinder, the method comprising:

actuating the hot displacer to move from its central position to its remote position;

actuating the cold displacer to move from its central position to its remote position;

actuating the hot displacer to move from its remote position to its central position; and actuating the cold displacer to move from its remote position to its central position wherein:

the actuations occur in the given order movement of the hot displacer from its central position to its remote position comprises a first period;

movement of the cold displacer from its central position to its remote position takes a second period;

the hot displacer remains stationary in its remote position for greater than the second period before starting to move to its central position;

the actuating the hot displacer to move from its central position to its remote position comprises process one;

the actuating the cold displacer to move from its central position to its remote position comprises process two;

the actuating the hot displacer to move from its remote position to its central position comprises process three;

the actuating the cold displacer to move from its remote position to its central position comprises process four; and a cycle comprises: process one followed by process two followed by process three followed by process four.

2. The method of claim 1, further comprising:

initiating process two before process one is complete; and initiating process four before process three is complete.

3. The method of claim 1, further comprising:

initiating process one before process four is complete; and initiating process three before process two is complete.

4. A heat pump, comprising:

a hot displacer disposed in a hot displacer cylinder;

a cold displacer disposed in a cold displacer cylinder;

a hot displacer actuator which when actuated causes the hot displacer to reciprocate between remote and central positions within the hot displacer cylinder; and a cold displacer actuator which when actuated causes the cold displacer to reciprocate between remote and central positions within the cold displacer cylinder;

an electronic control unit (ECU) coupled to the hot displacer actuator and the cold displacer actuator, wherein:

the ECU commands the hot displacer and cold displacers to move through a series of arrangements:

a first arrangement in which the hot displacer is at its central position within the hot displacer cylinder and the cold displacer is proximate its central position with the cold displacer cylinder;

a second arrangement in which the hot displacer is at its remote position within the hot displacer cylinder and the cold displacer is proximate its central position with the cold displacer cylinder;

a third arrangement in which the hot displacer within the hot displacer cylinder is at its remote position and the cold displacer is proximate its remote position within the cold displacer cylinder; and a fourth arrangement in which the hot displacer is at its central position within the hot displacer cylinder and the cold displacer is proximate its remote position within the cold displacer cylinder; wherein;

the ECU commands the hot displacer to remain stationary in its remote position for a period significantly longer than it takes for the cold displacer to move from the second arrangement to the third arrangement before commanding the hot displacer to attain the fourth arrangement; and the ECU commands the hot displacer to remain stationary in its central position for a period longer than it takes for the cold displacer to move from the fourth arrangement to the first arrangement before commanding the hot displacer to attain the second arrangement.

5. The heat pump of claim 4 wherein: a cycle comprises moving from the first arrangement to the second arrangement to the third arrangement to the fourth arrangement to the first arrangement.

6. The heat pump of claim 5, wherein:

the ECU commands the cold displacer to remain stationary in its central position for a period significantly longer than it takes for the hot displacer to move from the first arrangement to the second arrangement; and the ECU commands the cold displacer to remain stationary in its remote position for a period significantly longer than it takes for the hot displacer to move from the third arrangement to the fourth arrangement.

7. The heat pump of claim 5 wherein:

a first process comprises moving from the first arrangement to the second arrangement;

a second process comprises moving from the second arrangement to the third arrangement;

a third process comprises moving from the third arrangement to the fourth arrangement;

a fourth process comprises moving from the fourth arrangement to the first arrangement; and both displacers remain stationary for a first period of time between the first and second processes;

both displacers remain stationary for a second period of time between the second and third processes;

both displacers remain stationary for a third period of time between the third and fourth processes; and both displacers remain stationary for a fourth period of time between the fourth and first processes.

8. The heat pump of claim 4 wherein a central axis of the cold displacer cylinder is collinear with a central axis of the hot displacer cylinder.

9. The heat pump of claim 4 wherein a diameter of the hot displacer cylinder is greater than a diameter of the cold displacer cylinder.

10. The heat pump of claim 4 wherein a distance that the hot displacer moves from its remote position to its central position is greater than a distance that the cold displacer moves from it remote position to its central position.

11. The heat pump of claim 4 wherein a time that it takes for the hot displacer to move between its central and remote positions is different than a time that it takes for the cold displacer to move between its central and remote positions.

* * * * *